US009175460B2

(12) United States Patent
Ukigai et al.

(10) Patent No.: US 9,175,460 B2
(45) Date of Patent: Nov. 3, 2015

(54) SHOWER APPARATUS

(75) Inventors: Kiyotake Ukigai, Kitakyushu (JP); Minoru Sato, Kitakyushu (JP); Takahiro Ohashi, Kitakyushu (JP); Yutaka Aihara, Kitakyushu (JP); Minami Okamoto, Kitakyushu (JP); Katsuya Nagata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 729 days.

(21) Appl. No.: 13/030,686

(22) Filed: Feb. 18, 2011

(65) Prior Publication Data

US 2011/0198415 A1 Aug. 18, 2011

(30) Foreign Application Priority Data

Feb. 18, 2010 (JP) ..... 2010-033979

(51) Int. Cl.

| | |
|---|---|
| ***E03C 1/08*** | (2006.01) |
| ***E03C 1/04*** | (2006.01) |
| ***B05B 1/18*** | (2006.01) |
| ***B05B 7/04*** | (2006.01) |

(52) U.S. Cl.

CPC ..... *E03C 1/0409* (2013.01); *B05B 1/18* (2013.01); *B05B 7/0425* (2013.01)

(58) Field of Classification Search

CPC ..... B05B 7/14; B05B 1/18; B05B 7/0425; E03C 1/0409; E03C 1/08

USPC ..... 239/428, 428.5, 509, 553, 553.3, 553.5; 261/DIG. 22; 4/615, 541.4, 541.5

See application file for complete search history.

(56) References Cited

U.S. PATENT DOCUMENTS

| | | | | |
|---|---|---|---|---|
| 3,633,824 | A * | 1/1972 | Aghnides | 239/428.5 |
| 3,796,377 | A * | 3/1974 | O'Hare | 239/428.5 |
| 4,135,670 | A * | 1/1979 | Sugimoto | 239/428.5 |
| 4,629,124 | A * | 12/1986 | Gruber | 239/428.5 |

(Continued)

FOREIGN PATENT DOCUMENTS

| | | | |
|---|---|---|---|
| EP | 2 260 945 | A1 | 12/2010 |
| GB | 2470805 | A | 12/2010 |

(Continued)

OTHER PUBLICATIONS

The Extended European Search Report dated Jun. 1, 2011; Application No. 11250196.0-2425.

(Continued)

*Primary Examiner* — Arthur O Hall
*Assistant Examiner* — Chee-Chong Lee
(74) *Attorney, Agent, or Firm* — Studebaker & Brackett PC

(57) ABSTRACT

Provided is a shower apparatus which can stably produce and supply bubbly water to nozzle holes, causing finely divided water droplets of relatively large, uniform size to land continuously on a user so as to allow the user to enjoy a shower with a voluminous feel as if the user were being showered by large drops of rain. The shower apparatus includes a water supply unit, a throttle unit adapted to eject passing water downstream, an aeration unit adapted to produce bubbly water by aerating the water ejected through the throttle unit, and a nozzle unit provided with a plurality of nozzle holes used to discharge the bubbly water, wherein an ejection speed changing means is installed in the water supply unit to at least partially vary ejection speeds of the water ejected from respective throttle channels of the plurality of throttle channels of the throttle unit.

10 Claims, 9 Drawing Sheets

(56) References Cited

U.S. PATENT DOCUMENTS

| | | | | |
|---|---|---|---|---|
| 5,154,355 | A * | 10/1992 | Gonzalez | 239/428.5 |
| 6,270,022 | B1 * | 8/2001 | Knapp | 239/428.5 |
| 6,869,030 | B2 * | 3/2005 | Blessing et al. | 239/394 |
| 7,913,934 | B2 | 3/2011 | Schorn | |
| 2006/0163391 | A1 | 7/2006 | Schorn | |
| 2008/0272212 | A1 | 11/2008 | Denzler | |
| 2009/0266430 | A1 | 10/2009 | Yang | |

FOREIGN PATENT DOCUMENTS

| | | | |
|---|---|---|---|
| JP | H06-182262 | A | 7/1994 |
| JP | 2002-102100 | A | 4/2002 |
| JP | 3747323 | B1 | 2/2006 |
| JP | 2006-509629 | A | 3/2006 |
| JP | 2006-239106 | A | 9/2006 |
| JP | 2009-279484 | A | 12/2009 |
| JP | 2010-162532 | A | 7/2010 |
| JP | 2010-188046 | A | 9/2010 |
| WO | 81/02253 | A1 | 8/1981 |
| WO | 2004/052550 | A1 | 6/2004 |
| WO | 2010/070904 | A1 | 6/2010 |

OTHER PUBLICATIONS

The Extended European Search Report dated Jun. 6, 2011; Application No. 11250197.8-2425.

* cited by examiner

SHOWER APPARATUS

BACKGROUND OF THE INVENTION

1. Field of the Invention

The present invention relates to a shower apparatus.

2. Description of the Related Art

In the present technical field, a shower apparatus is known which discharges bubbly water by aerating water using a so-called ejector effect. Since the water flowing into the shower apparatus is distributed to multiple nozzle holes and sprayed therefrom, when the spray is aerated, the water flowing into the apparatus is aerated before being distributed among the nozzle holes.

An example of such a shower apparatus is proposed in National Publication of International Patent Application No. 2006-509629. The shower apparatus described in National Publication of International Patent Application No. 2006-509629 comprises a plurality of nozzle holes provided in a front face of a disk-shaped housing shell and is configured to discharge water flowing in through the center of a rear face of the housing shell by distributing the water to the plurality of nozzle holes. The shower apparatus produces bubbly water by aerating the water which has flowed into the housing shell and distributes the bubbly water to the plurality of nozzle holes formed so as to distribute over the entire front face of the housing shell. Therefore, a turbulence generation/expansion unit is placed in a traveling direction of the bubbly water, causing the bubbly water to change direction by colliding with the turbulence generation/expansion unit and thereby spread over the entire front face of the housing shell.

Another example of a shower apparatus is proposed in Japanese Patent Laid-Open No. 2006-239106. With the shower apparatus described in Japanese Patent Laid-Open No. 2006-239106, when a cock such as a hot and cold mixer tap is opened, water is supplied from a hose and passed through an orifice member. Then, the water is mixed with air sucked through an inner suction port open to a decompression chamber installed on a downstream side of the orifice member and maintained under reduced pressure at the given moment. The shower apparatus described in Japanese Patent Laid-Open No. 2006-239106 produces bubbly water in this way and discharges the bubbly water through a plurality of nozzle holes provided in a shower head. With the shower apparatus, the produced bubbly water proceeds to the nozzle holes by changing direction by hitting a threaded member in a partitioned pipe installed on the downstream side of the decompression chamber as well as inner walls of the shower head installed further downstream.

SUMMARY OF THE INVENTION

In spraying a shower using bubbly water produced by aerating water, how to set the feel of the bubbly water hitting a user plays an important role in a quality feel experienced by the user who takes a shower. The shower apparatus described in Japanese Patent Laid-Open No. 2006-239106 is intended to achieve the sensation of water hitting the user intermittently as described in paragraph 0015 of the patent literature. The term "intermittently" means that finely divided water droplets of nonuniform sizes hit the user. It is considered that the term expresses a mixed sensation of strong and weak showers which can be experienced by the user if hit by large-size water droplets which produce a sensation of a strong shower and small-size water droplets which produce a sensation of a weak shower. According to concrete studies conducted by the present inventors, it is presumed that in the bubbly water just produced, water is mixed substantially uniformly with air. Subsequently, the bubbles collide with each other as the produced bubbly water changes direction by hitting the threaded member and the inner walls of the shower head, and it is considered that bubble diameters are nonuniform when the bubbly water reaches the nozzle holes. Then, when discharged from the nozzle holes, the bubbly water turns into water droplets of nonuniform sizes. It is considered that the sensation described above is achieved by directing the water droplets of nonuniform sizes at the user.

On the other hand, National Publication of International Patent Application No. 2006-509629 does not give any concrete description of properties of the bubbly water discharged from the shower apparatus described in the patent literature. However, as in the case of the shower apparatus described in Japanese Patent Laid-Open No. 2006-239106, it is considered that the shower apparatus described in National Publication of International Patent Application No. 2006-509629 produces water droplets of nonuniform sizes by supplying and discharging bubbly water with nonuniform bubble diameters from the nozzle holes and directs the water droplets of nonuniform sizes at the user. In the shower apparatus described in National Publication of International Patent Application No. 2006-509629, the turbulence generation/expansion unit is placed in the traveling direction of the bubbly water, causing the bubbly water to change direction by colliding with the turbulence generation/expansion unit. Thus, presumably similar nonuniform bubble growth takes place in the shower apparatus described in National Publication of International Patent Application No. 2006-509629 and resulting water droplets of nonuniform sizes are directed at the user.

Under these circumstances, the present inventors intended to provide a shower apparatus which enables spray of a shower with a comfortable voluminous feel as if one were being showered by large drops of rain. The above-described conventional techniques, which achieve the sensation of nonuniformly-sized water droplets hitting the user as described above, do not provide spray of a shower with a voluminous feel as if the user were being showered by large drops of rain.

To provide spray of a shower with such a new feel, the present inventors paid attention to the state of bubbly water in nozzle holes and just after discharge from the nozzle holes. In the nozzle holes and after discharge from the nozzle holes, since the bubbly water is in a state of gas-liquid, two-phase flow in which two different types of fluid—gas and liquid—coexist and move in the same flow conduit, the bubbly water is considered to be flowing in any of the typical flow patterns of bubble flow, slug flow, and annular flow. Since these flow patterns differ in the manner of bubble inclusion, it is considered that they also differ in the manner of fine division after discharge from the nozzle holes. Thus, the present inventors assumed that with the conventional techniques, since the bubble diameters in the bubbly water supplied to the nozzle holes are nonuniform, the bubbly water is discharged under the coexistence of bubble flow, slug flow, and annular flow, resulting in the sensation of nonuniformly-sized water droplets hitting the user. Based on this assumption, the present inventors considered it important to control the bubble diameters of the bubbly water supplied to the nozzle holes to be uniform.

However, since water is normally supplied to a shower apparatus through a single supply port, bubbly water is produced by aerating the water supplied through the single supply port. On the other hand, since multiple nozzle holes are provided, the bubbly water is stimulated when being distributed to the nozzle holes by changing the direction of the bubbly water, and thus it is extremely difficult to discharge the water from the nozzle holes without causing the air bubbles to grow.

To solve this problem, the present inventors worked out a basic concept of a shower apparatus which causes finely divided water droplets of relatively large, uniform size to land continuously on the user by supplying bubbly water whose bubble diameter is kept as uniform as possible to the nozzle holes. Such a shower apparatus allows the user to enjoy a shower with a voluminous feel as if the user were being showered by large drops of rain.

The shower apparatus thus conceived by the present inventors causes finely divided water droplets of relatively large, uniform size to land continuously on the user by supplying bubbly water whose bubble diameter is kept as uniform as possible to the nozzle holes and thereby allows the user to enjoy a shower with a voluminous feel as if the user were being showered by large drops of rain. Specifically, the shower apparatus includes a water supply unit adapted to supply water, a throttle unit installed downstream of the water supply unit and adapted to make a cross sectional area of a flow channel smaller than the water supply unit and thereby eject passing water downstream, an aeration unit installed downstream of the throttle unit and provided with an opening adapted to produce bubbly water by aerating the water ejected through the throttle unit, and a nozzle unit installed downstream of the aeration unit and provided with a plurality of nozzle holes adapted to discharge the bubbly water.

In the shower apparatus described above, in order to supply the bubbly water by keeping bubble diameter as uniform as possible, it is necessary to reduce turbulence to prevent the air bubbles in the bubbly water from colliding with each other whenever possible once the bubbly water is produced. However, the present inventors found that adoption of a configuration for reducing turbulence posed a new problem not encountered conventionally: namely, the configuration acts to reduce the very amount of bubble inclusion, making it difficult to supply a sufficient amount of bubbly water to the nozzle holes.

The present invention has been made in view of the above problem and has an object to provide a shower apparatus which can stably produce and supply bubbly water to nozzle holes by keeping bubble diameter in the bubbly water as uniform as possible, thereby causing finely divided water droplets of relatively large, uniform size to land continuously on the user so as to allow the user to enjoy a shower with a voluminous feel as if the user were being showered by large drops of rain.

To solve the above problem, the present invention provides a shower apparatus for discharging aerated bubbly water, comprising: a water supply unit adapted to supply water; a throttle unit installed downstream of the water supply unit and adapted to make a cross sectional area of a flow channel smaller than the water supply unit and thereby eject passing water downstream; an aeration unit installed downstream of the throttle unit and provided with an opening adapted to produce the bubbly water by aerating the water ejected through the throttle unit; and a nozzle unit installed downstream of the aeration unit and provided with a plurality of nozzle holes adapted to discharge the bubbly water by being formed along an ejection direction of the water ejected through the throttle unit. The throttle unit comprises a plurality of throttle channels installed in parallel, and ejection speed changing means adapted to at least partially vary ejection speeds of the water ejected from respective throttle channels of the plurality of throttle channels.

According to the present invention, the water supplied from the water supply unit is ejected to the aeration unit and nozzle unit through the throttle unit, and the water temporarily pooled in the aeration unit and nozzle unit is discharged outside through the plurality of nozzle holes in the nozzle unit. By involving air taken in through the opening formed in the aeration unit, the water ejected through the throttle unit plunges into an air-liquid interface between air and the water temporarily pooled in the aeration unit and nozzle unit and thereby turns into bubbly water to be sprayed through the plurality of nozzle holes in the nozzle unit.

In a stage in which the water ejected through the throttle unit plunges into the air-liquid interface and thereby turns into bubbly water, the air bubbles in the bubbly water can be configured to have a substantially uniform diameter. Thus, the bubbly water can reach the location where the nozzle holes are formed while maintaining the substantially uniform diameter. As the bubbly water containing air bubbles of such a substantially uniform diameter is supplied to the nozzle holes, a bubble flow or slug flow can be formed in the nozzle holes or just after discharge from the nozzle holes. When discharged from the nozzle holes, the bubbly water containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. This causes finely divided water droplets of relatively large, uniform size to land continuously on the user and thereby allows the user to enjoy a shower with a voluminous feel as if the user were being showered by large drops of rain.

Furthermore, according to the present invention, since the throttle unit comprises the plurality of throttle channels installed in parallel, water is ejected by being divided among the plurality of throttle channels to produce bubbly water. This makes it possible to produce the bubbly water without greatly disturbing the flow of water. In this way, since the bubbly water is produced without greatly disturbing the flow of water, the air bubbles in the bubbly water tend to decrease if a usual method is used. Thus, the present invention curbs the decrease in the air bubbles by inducing flow of water near the air-liquid interface and thereby involving air with the ejected water. Specifically, by at least partially varying ejection speeds of the water ejected from the respective throttle channels of the plurality of throttle channels, the present invention induces such a flow of water that will involve air at the air-liquid interface using differences among the ejection speeds and thereby increases the number of air bubbles without enlarging the air bubbles.

Furthermore, the present invention comprises ejection speed changing means adapted to at least partially vary ejection speeds of the water ejected from the respective throttle channels of the plurality of throttle channels. The ejection speed changing means can change flow velocities of the water flowing through the plurality of throttle channels or rates of water supply to the plurality of throttle channels, consequently making it possible to at least partially vary the ejection speeds of the water ejected from the respective throttle channels of the plurality of throttle channels.

Also, in the shower apparatus according to the present invention, preferably the ejection speed changing means comprises a supply rate changing unit adapted to supply water to the throttle unit by at least partially varying supply rates of the water supplied to the respective throttle channels of the plurality of throttle channels. Preferably the supply rate changing unit is installed in the water supply unit.

According to this preferred aspect, the supply rate changing unit is installed in the water supply unit to supply water to the throttle unit by at least partially varying the supply rates of the water supplied to the respective throttle channels of the plurality of throttle channels. In this way, the ejection speeds of the water ejected from the plurality of throttle channels are designed to be varied by installing the supply rate changing unit in the water supply unit and thereby changing the supply rates of the water supplied to the plurality of throttle channels. This makes it possible to ensure a sufficient amount of bubble inclusion in the bubbly water using a simple configuration by making changes only to the water supply unit without making particular changes to the throttle channels.

Also, in the shower apparatus according to the present invention, the bubbly water is produced when the water ejected from each of the plurality of throttle channels plunges into an air-liquid interface between air and the water temporarily pooled in the aeration unit and nozzle unit. Preferably the air-liquid interface is formed downstream of the opening, but upstream of the nozzle holes.

According to this preferred aspect, the water ejected from the plurality of throttle channels plunges into the air-liquid interface by being arranged in parallel lines. This allows forces applied by the ejected water to be transmitted evenly to the entire air-liquid interface, making it possible to stably position the air-liquid interface between the nozzle holes and opening. In this way, since the shower apparatus stably forms the air-liquid interface, produces bubbly water by causing the water ejected from the plurality of throttle channels to plunge into the air-liquid interface, and creates differences among the ejection speeds of the water ejected from the plurality of throttle channels, it is possible to induce such a flow of water that will involve surrounding air at the stable air-liquid interface using the differences among the ejection speeds and thereby increase the number of air bubbles without enlarging the air bubbles.

Also, in the shower apparatus according to the present invention, preferably at least some of the plurality of throttle channels are arranged side by side in a lateral direction along a nozzle face in which the plurality of nozzle holes are provided. Also, preferably the water is ejected from the plurality of throttle channels such that the speed of the water ejected from the throttle channels installed on a center side and the speed of the water ejected from the throttle channels installed on lateral sides will be different from each other.

According to this preferred aspect, at least some of the plurality of throttle channels are arranged side by side in the lateral direction along the nozzle face in which the plurality of nozzle holes are provided. Consequently, the throttle channels are arranged by being spread out and scattered in the lateral direction, thereby making it easy to change the speeds of ejected water in the lateral direction in which the throttle channels ejecting the water are arranged side by side. Furthermore, according to this preferred aspect, the water is ejected from the plurality of throttle channels such that the speed of the water ejected from the throttle channels installed on the center side and the speed of the water ejected from the throttle channels installed on the lateral sides will be different from each other. Therefore, for example, the speed of the water on the lateral sides can be differed from the speed of the water on the center side, making it easy to eject water with a speed difference. Water ejection carried out in this way can induce such a flow of water that will involve surrounding air at the air-liquid interface thereby increase the number of air bubbles without enlarging the air bubbles.

Also, in the shower apparatus according to the present invention, preferably the water is ejected from the plurality of throttle channels such that the speed of the water ejected from the throttle channels installed on the center side will be faster than the speed of the water ejected from the throttle channels installed on lateral sides.

According to this preferred aspect, the water is ejected from the plurality of throttle channels such that the speed of the water ejected from the throttle channels installed on the center side will be faster than the speed of the water ejected from the throttle channels installed on the lateral sides. Therefore, by reducing the water ejection speed on the lateral sides with respect to the center side from which water is ejected at the faster speed, the speed of ejected water can be varied with regularity. This makes it possible to involve air while suppressing disturbance of water near the air-liquid interface and thereby increase the number of air bubbles without enlarging the air bubbles.

Also, in the shower apparatus according to the present invention, preferably the lateral length along which the throttle channels of the throttle unit are arranged side by side is longer than the water passage diameter in the water supply unit.

According to this preferred aspect, the length of the throttle unit in the direction along which the throttle channels are arranged side by side is configured to be longer than the water passage diameter in the water supply unit. Consequently, the water entering the throttle unit by being supplied to the center side of the throttle unit from the water supply unit spreads to the lateral sides, causing water to be ejected from the throttle channels installed on the center side at a faster speed than from the throttle channels installed on the lateral sides. By simply configuring the lateral length of the throttle unit to be longer than the water passage diameter in the water supply unit, it is possible to supply water with a speed difference to the throttle channels.

Also, in the shower apparatus according to the present invention, preferably at least some of the plurality of throttle channels are arranged by being offset from each other in an up-and-down direction orthogonal to a nozzle face in which the plurality of nozzle holes are provided. Also, preferably the water ejected from the plurality of throttle channels is varied in speed depending on locations along the up-and-down direction.

According to this preferred aspect, at least some of the plurality of throttle channels are arranged by being offset from each other in the up-and-down direction. Also, the water ejected from the plurality of throttle channels is varied in speed depending on locations along the up-and-down direction. Consequently, the throttle channels are arranged by being spread out and scattered in a vertical direction, thereby making it easy to change the speeds of the water ejected from the throttle channels arranged by being offset from each other in the vertical direction.

Also, in the shower apparatus according to the present invention, preferably the water is ejected from the plurality of throttle channels such that the speed of the water ejected from the throttle channels installed on an upper side will be faster than the speed of the water ejected from the throttle channels installed on a lower side.

According to this preferred aspect, since the water is ejected from the throttle channels installed on the upper side at a faster speed than from the throttle channels installed on the lower side, bubbly water is produced by taking in a larger amount of air on the upper side where the faster water streams pass. Therefore, even if an opening is provided only on the upper side of the aeration unit, air can be taken in reliably using the faster water streams. This makes it possible to facilitate the flow of water ejected from the throttle channels.

Also, in the shower apparatus according to the present invention, preferably a wall face of a water passage of the water supply unit is bent at least on the lower side so as to form an inflection region protruding into the water passage. This causes water to be supplied to the throttle channels installed on the upper side at a faster speed than to the throttle channels installed on the lower side.

According to this preferred aspect, since the wall face of the water passage of the water supply unit is bent at least on the lower side so as to form the inflection region protruding into the water passage, as water passes the bent portion, an apparent flow channel expands suddenly, causing flow separation and thereby resulting in a speed difference. Thus, by simply bending the water passage of the water supply unit, a speed difference can be created in the up-and-down direction of the water supplied to the throttle unit. This makes it possible to supply water to the throttle channels installed on the upper side at a faster speed than to the throttle channels installed on the lower side.

Also, in the shower apparatus according to the present invention, preferably the plurality of throttle channels are arranged side by side in a lateral direction along a nozzle face in which the plurality of nozzle holes are provided and are arranged by being offset from each other in an up-and-down direction orthogonal to the nozzle face in which the plurality of nozzle holes are provided. Also, preferably the water is ejected from the plurality of throttle channels such that in the lateral direction, the speed of the water ejected from the throttle channels installed on a center side and the speed of the water ejected from the throttle channels installed on lateral sides will be different from each other and that there will also be a speed difference depending on locations along the up-and-down direction.

According to this preferred aspect, the plurality of throttle channels are arranged side by side in the lateral direction along the nozzle face in which the plurality of nozzle holes are provided and are arranged by being offset from each other in the up-and-down direction orthogonal to the nozzle face in which the plurality of nozzle holes are provided, meaning that the throttle channels are arranged by being scattered both in the lateral direction and up-and-down direction. Since the throttle channels are arranged by being spread out and scattered in the lateral direction, it is easy to change the speeds of ejected water in the lateral direction in which the throttle channels ejecting the water are arranged side by side. Furthermore, since the throttle channels are arranged by being spread out and scattered in the vertical direction, it is easy to change the speeds of the water ejected from the throttle channels arranged by being offset from each other in the vertical direction.

Also, in the shower apparatus according to the present invention, preferably the plurality of throttle channels are arranged by being divided into a plurality of tiers in the up-and-down direction.

According to this preferred aspect, the plurality of throttle channels are arranged by being divided into a plurality of tiers in the up-and-down direction, thereby causing the plurality of throttle channels to be offset from each other in the up-and-down direction. Consequently, the positional offset in the up-and-down direction becomes prominent. This makes it easy to increase the amount of air intake by more prominently changing the speeds of the water ejected from the throttle channels arranged by being offset from each other in the vertical direction.

Also, in the shower apparatus according to the present invention, preferably the plurality of throttle channels are arranged such that the throttle channels placed in a first tier will be offset in position from the throttle channels placed in a second tier.

According to this preferred aspect, since the throttle channels placed in the first tier are offset in position from the throttle channels placed in the second tier, each throttle channel placed in the second tier can be positioned above or below the interval between each pair of throttle channels in the first tier. This makes it easy to provide a predetermined distance so as to prevent the water ejected from the throttle channels placed in the first tier from colliding with the water ejected from the throttle channels placed in the second tier. Consequently, it becomes possible to more prominently change the speeds of the water ejected from the throttle channels arranged by being offset from each other in the vertical direction. Also, it becomes possible to reduce collisions among the water streams ejected from the plurality of throttle channels and inhibit enlargement of the air bubbles while making it easy to increase the amount of air intake.

Also, in the shower apparatus according to the present invention, preferably the plurality of throttle channels are placed at equal intervals.

According to this preferred aspect, by placing the plurality of throttle channels at equal intervals, it becomes possible to reduce interference among the water streams ejected from the plurality of throttle channels, suppress disturbance of water near the air-liquid interface, and inhibit enlargement of the air bubbles.

The present invention can stably produce and supply bubbly water to the nozzle holes by keeping bubble diameter in the bubbly water as uniform as possible, thereby causing finely divided water droplets of relatively large, uniform size to land continuously on the user so as to allow the user to enjoy a shower with a voluminous feel as if the user were being showered by large drops of rain.

BRIEF DESCRIPTION OF THE DRAWINGS

FIG. 1(A) is a plan view, FIG. 1(B) is a side view, and FIG. 1(C) is a bottom view;

DESCRIPTION OF SYMBOLS

Figure 1A:
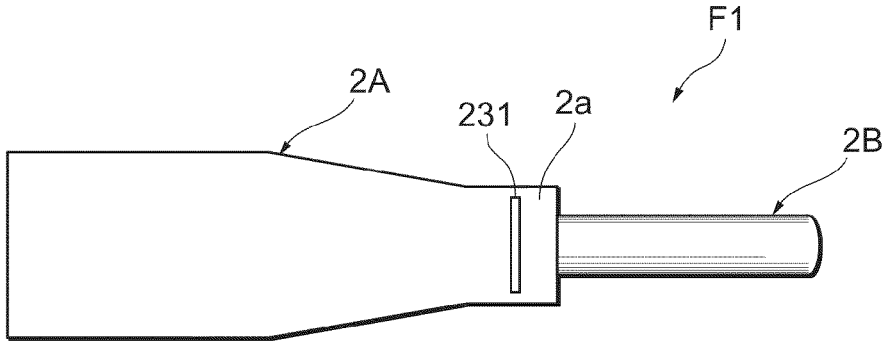
FIGS. 1(A) to 1(C) are diagrams showing a shower apparatus according to an embodiment of the present invention, where

F1: Shower apparatus
2A, 2B: Body
2*a*: Top face

2*b*: Bottom face
21: Water supply unit
21*a*: Water passage
21*aa*, 21*ac*, 21*ad*, 21*af*, 21*ag*, 21*ai*, 21*aj*, 21*am*: Side wall
21*ab*, 21*ah*, 21*ak*: Convex portion
21*ae*: Concave portion
22: Throttle unit
22*a*: Partition wall
221: Throttle channel
23: Aeration unit
23*b*: Side wall
23*c*: Side wall
23*d*: Side wall
23*ea*: Side wall
23*eb*: Side wall
23*fa*: Side wall
23*fb*: Side wall
23*g*: Stepped portion
231: Opening
24: Nozzle unit
24*a*: Side wall
24*b*: Side wall
24*c*: Side wall
24*e*: Side wall
24*f*: Side wall
242: Nozzle stub
243: Nozzle holes
BW: Bubbly water
BW3: Air-liquid interface
W1, W2, W1*a*, W1*b*, W1*c*: Water stream

DETAILED DESCRIPTION OF THE PREFERRED EMBODIMENTS

An embodiment of the present invention will be described below with reference to the accompanying drawings. To facilitate understanding of the description, the same components in different drawings are denoted by the same reference numerals whenever possible and redundant description thereof will be omitted.

Figure 1B:
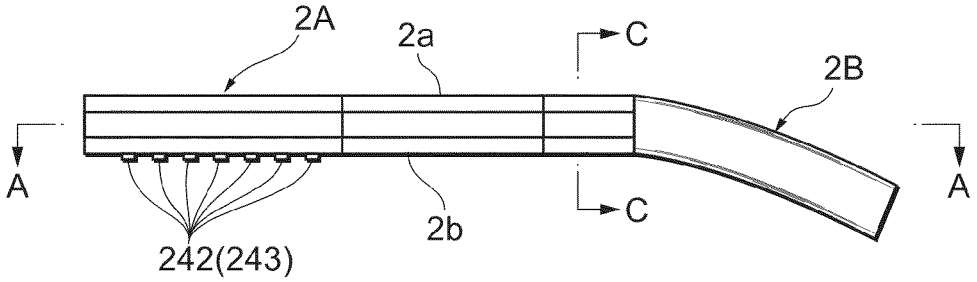
Figure 1C:
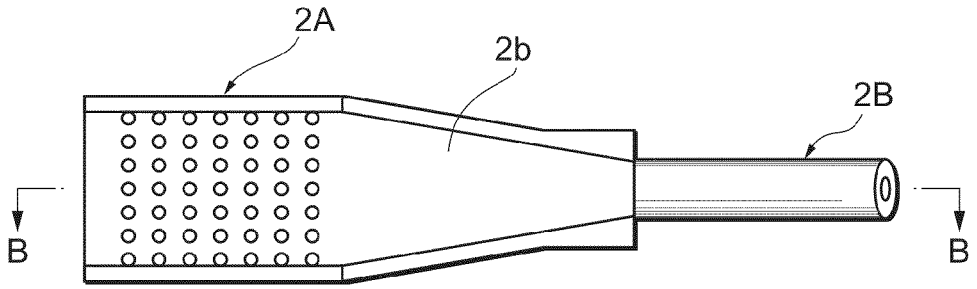

A shower apparatus which is an embodiment of the present invention will be described with reference to FIG. 1. FIGS. 1(A) to 1(C) are diagrams showing a shower apparatus F1 according to the embodiment of the present invention, where FIG. 1(A) is a plan view, FIG. 1(B) is a side view, and FIG. 1(C) is a bottom view. As shown in FIG. 1(A), the shower apparatus F1 includes a body 2A shaped as a rectangular paralleled pipe which is narrowed at one end, and a body 2B shaped as a hose connected to the narrowed end of the body 2A. An opening 231 is formed in a top face 2*a* of the body 2A of the shower apparatus F1.

As shown in FIG. 1(B), a plurality of nozzle stubs 242 are provided in a bottom face 2*b* opposite the top face 2*a* of the body 2A of the shower apparatus F1. A nozzle hole 243 is formed in each nozzle stub 242. As shown in FIG. 1(C), the plurality of nozzle stubs 242 are provided in the bottom face 2*b* of the body 2A. According to the present embodiment, seven rows by seven columns of nozzle stubs 242 are formed for a total of 49 nozzle stubs.

Figure 2:
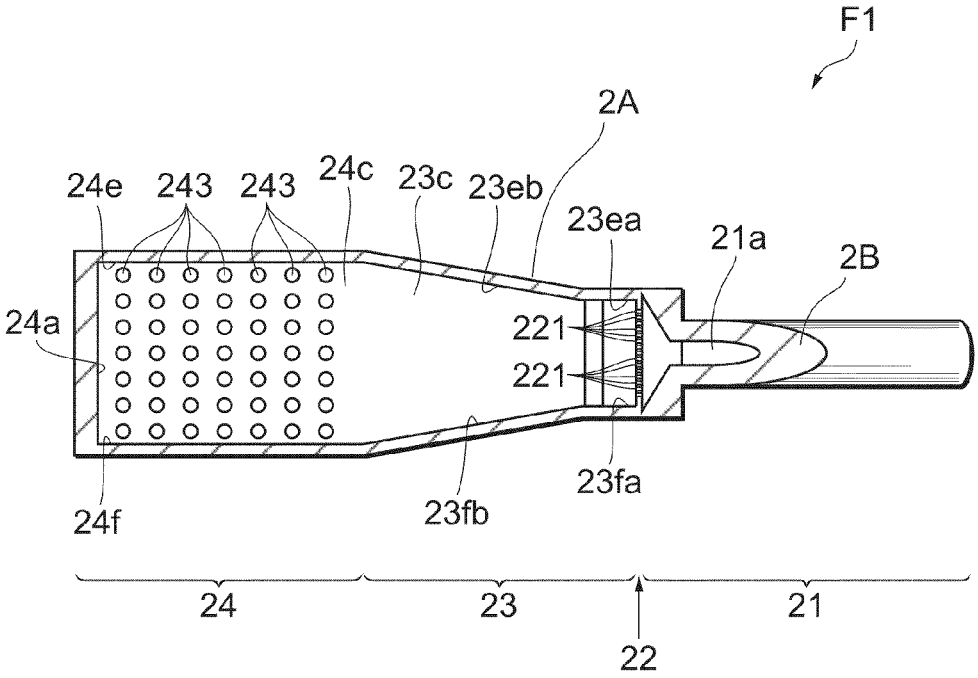
FIG. 2 is a sectional view taken along line A-A in FIG. 1(B)

Next, the shower apparatus F1 will be described with reference to FIG. 2, which is a sectional view taken along line A-A in FIG. 1(B). As shown in FIG. 2, the shower apparatus F1 includes a water supply unit 21, throttle unit 22, aeration unit 23, and nozzle unit 24.

The water supply unit 21 is a part intended to supply water and adapted to supply water introduced externally from a water supply hose, water pipe, or the like to the throttle unit 22. The water supply unit 21 is formed between the body 2B and body 2A and contains a supply rate changing unit according to the present invention. A configuration of the supply rate changing unit will be described in detail later.

Figure 4:
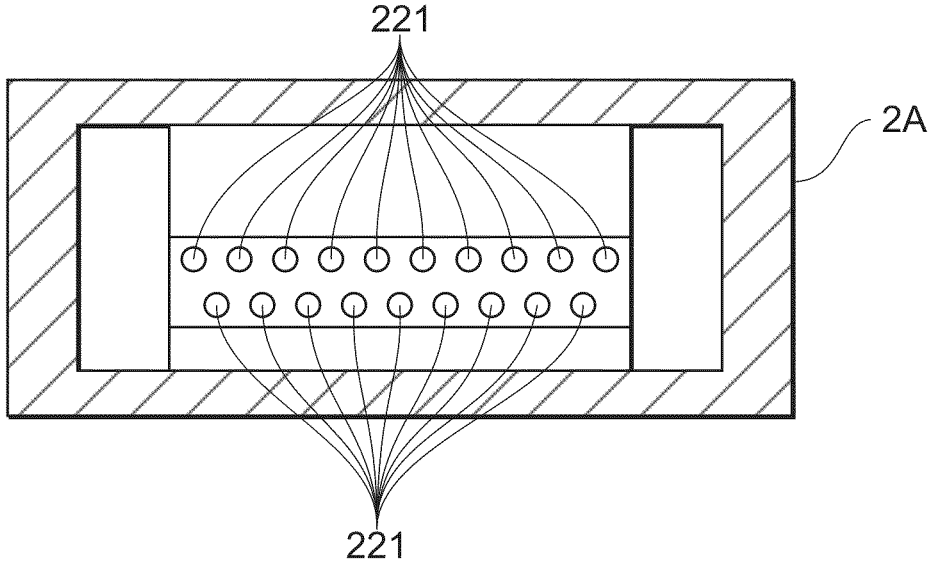
FIG. 4 is a sectional view taken along line C-C in FIG. 1(B), showing a flow of water in the shower apparatus.

The throttle unit 22 is a part installed downstream of the water supply unit 21 and adapted to make the cross sectional area of a flow channel smaller than the water supply unit 21 and thereby eject passing water downstream. A plurality of throttle channels 221 are installed in the throttle unit 22. The throttle channels 221 are arranged side by side in two tiers along an up-and-down direction in FIG. 2. FIG. 4 shows how the throttle channels 221 are arranged. FIG. 4 is a sectional view taken along line C-C in FIG. 1(B). As shown in FIG. 4, ten throttle channels 221 are formed in a line in the upper tier and nine throttle channels 221 are formed in a line in the lower tier. The throttle channels 221 in the lower tier are arranged so as to be positioned below intervals between the throttle channels 221 in the upper tier. That is, the throttle channels 221 in the upper tier and throttle channels 221 in the lower tier are placed alternately such that the distance to the closest throttle channel 221 in the other tier will be substantially equal. In other words, the plurality of throttle channels 221 arranged side by side are placed alternately in each of the plurality of tiers, i.e., upper and lower tiers, such that each throttle channel 221 will be placed at an equal distance to the respective pair of throttle channels 221 installed in the adjacent tier. Also, the throttle channels 221 placed in the upper tier, i.e., the first tier, and the throttle channels 221 placed the lower tier, i.e., the second tier, are offset in position from each other, being arranged in a staggered, zigzag fashion.

Returning to FIG. 2, description of other parts will be continued. The aeration unit 23 is a part installed downstream of the throttle unit 22 and provided with the opening 231 (see FIG. 1(A)) used to aerate the water ejected through the throttle unit 22 and thereby turn the water into bubbly water. The aeration unit 23 includes side walls 23*ea* and 23*eb* and side walls 23*fa* and 23*fb*, as part of the body 2A, along a traveling direction of water. The side wall 23*ea* and side wall 23*fa* are placed so as to be parallel to each other. The side wall 23*eb* is installed downstream of the side wall 23*ea* consecutively with the side wall 23*ea* and placed obliquely so as to expand the flow channel outward from a portion connected to the side wall 23*ea* downstream. Similarly, the side wall 23*fb* is installed downstream of the side wall 23*fa* consecutively with the side wall 23*fa* and placed obliquely so as to expand the flow channel outward from a portion connected to the side wall 23*fa* downstream.

The nozzle unit 24 is a part installed downstream of the aeration unit 23 and provided with the plurality of nozzle holes 243 used to discharge bubbly water. The nozzle holes 243 are formed in the nozzle stubs 242.

As shown in FIG. 2, the side wall 23*ea* and side wall 23*fa* which make up part of the aeration unit 23 are placed in parallel, facing each other. The side wall 23*eb* which makes up the rest of the aeration unit 23 is placed obliquely, being oriented towards outer side faces of the body 2A, and is connected to a side wall 24*e* of the nozzle unit 24. Similarly, the side wall 23*fb* which makes up the rest of the aeration unit 23 is placed obliquely, being oriented towards outer side faces of the body 2A, and is connected to a side wall 24*f* of the nozzle unit 24.

Figure 3:
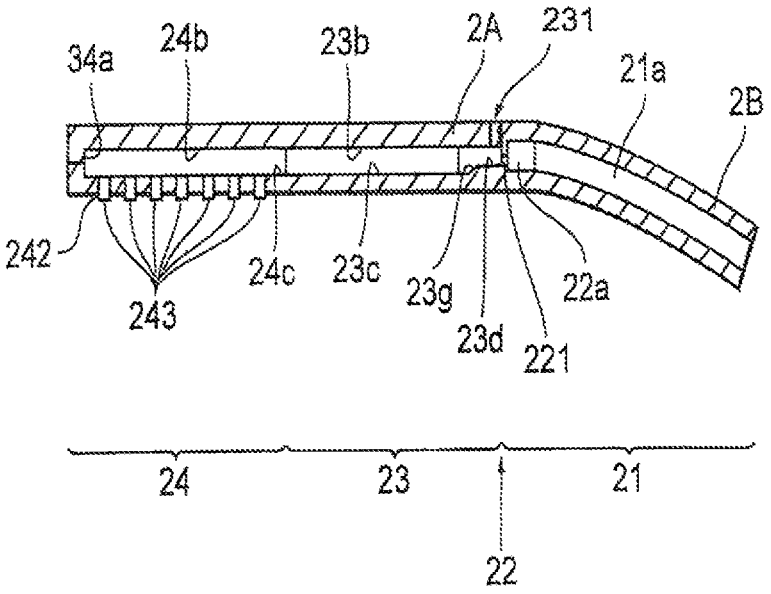
FIG. 3 is a sectional view taken along line B-B in FIG. 1(C)

Next, the shower apparatus F1 will be described with reference to FIG. 3, which is a sectional view taken along line B-B in FIG. 1(C). As shown in FIG. 3, the water supply unit 21 includes a water passage 21*a*. The water passage 21*a* is a bent water channel.

The throttle unit 22 is installed in a region beyond the downstream end of the water passage 21*a*. A cross section of the flow channel of the throttle unit 22 is formed to be flat-shaped. A partition wall 22*a* is installed in a boundary portion between the throttle unit 22 and aeration unit 23. A plurality of through-holes are made in the partition wall 22*a*, thereby forming the plurality of throttle channels 221.

The aeration unit 23 is installed in a region on the downstream side beyond the partition wall 22*a*. The aeration unit 23 includes a side wall 23*b*, side wall 23*c*, and side wall 23*d* which connect the side walls 23*ea* and 23*eb* with the side walls 23*fa* and 23*fb*, where the side wall 23*c* is placed at a location opposite to and relatively distant from the side wall 23*b* and the side wall 23*d* is placed at a location opposite to and relatively close to the side wall 23*b*. The side wall 23*c* is placed on the side of the nozzle unit 24 and the side wall 23*d* is placed on the side of the throttle unit 22. Besides, a stepped portion 23*g* is formed to connect the side wall 23*c* with the side wall 23*d*. The side walls 23*b*, 23*c*, and 23*d* are formed to be longer in length along a direction orthogonal to the direction in which water proceeds than the side walls 23*ea* and 23*eb* and side walls 23*fa* and 23*fb*. Therefore, the aeration unit 23 is formed such that the cross section of the flow channel will have a flat shape.

The nozzle unit 24 is installed in a region downstream of the side wall 23*c*. The nozzle unit 24 includes a side wall 24*b* connecting the side wall 24*e* with the side wall 24*f* and lying in the same plane as the side wall 23*b* of the aeration unit 23. Furthermore, the nozzle unit 24 includes a side wall 24*c* connecting the side wall 24*e* with the side wall 24*f* and lying in the same plane as the side wall 23*c* of the aeration unit 23. The side walls 24*b*, 24*c*, 24*e*, and 24*f* are connected to an inner-side side wall 24*a* which faces the partition wall 22*a* of the throttle unit 22 and functions as a terminal end of the flow channel. The side wall 24*c* has the nozzle stubs 242 as described above and tip portions of the nozzle stubs 242 are configured to protrude from the body 2A. The nozzle holes 243 are formed in the respective nozzle stubs 242.

When water is supplied to the water supply unit 21 configured as described above from water supply means (not shown) at or above a predetermined pressure, the water is ejected downstream through the throttle channels 221 formed in the throttle unit 22. The water is ejected downstream to the aeration unit 23 and the nozzle unit 24 through the throttle channels 221 such that a virtual water ejection straight line will extend to the most distant nozzle hole 243 while avoiding interference with the side walls 23*b*, 23*c*, 23*d*, 23*ea*, 23*eb*, 23*fa*, and 23*fb* of the aeration unit 23 and the side walls 24*b*, 24*c*, 24*d*, and 24*e* of the nozzle unit 24. The virtual water ejection straight line is a virtual straight line obtained by extending an ejection direction of the water ejected from the throttle unit 22.

When water is ejected from the throttle unit 22 in this way, water is temporarily accumulated in at least part of the nozzle unit 24 and aeration unit 23, forming an air-liquid interface, which is an interface between air and the accumulated water. Consequently, the water ejected along the virtual water ejection straight line plunges into the accumulated water through the air-liquid interface by involving the air existing in the aeration unit 23 and thereby produces bubbly water. The bubbly water is divided into water streams and discharged outside through the nozzle holes 243. Since the opening 231 is formed in the aeration unit 23, air can always be kept supplied even though the water ejected along the virtual water ejection straight line plunges into the accumulated water through the air-liquid interface by involving the air existing in the aeration unit 23.

In this way, the shower apparatus F1 according to the present embodiment can supply bubbly water to the nozzle holes by keeping bubble diameter in the bubbly water as uniform as possible, thereby causing finely divided water droplets of relatively large, uniform size to land continuously on the user so as to allow the user to enjoy a shower with a voluminous feel as if the user were being showered by large drops of rain.

In the shower apparatus F1, in order to supply bubbly water to the nozzle holes 243 by keeping bubble diameter in the bubbly water as uniform as possible, it is necessary to reduce turbulence to prevent the air bubbles from colliding with each other whenever possible once the bubbly water is produced. However, a configuration for reducing turbulence, if adopted, may act to reduce the very amount of bubble inclusion, making it difficult to supply a sufficient amount of bubbly water to the nozzle holes 243.

In the shower apparatus F1 according to the present embodiment, in order to stably produce and supply bubbly water to nozzle holes 243 and thereby cause finely divided water droplets of relatively large, uniform size to land continuously on the user so as to allow the user to enjoy a shower with a voluminous feel as if the user were being showered by large drops of rain, the supply rate changing unit is installed in the water passage 21*a*. The supply rate changing unit supplies water to the throttle unit 22 by at least partially varying the supply rates of the water supplied to the respective throttle channels of the plurality of throttle channels 221 so as to at least partially vary ejection speeds of the water ejected from the respective throttle channels of the plurality of throttle channels 221.

Figure 5:
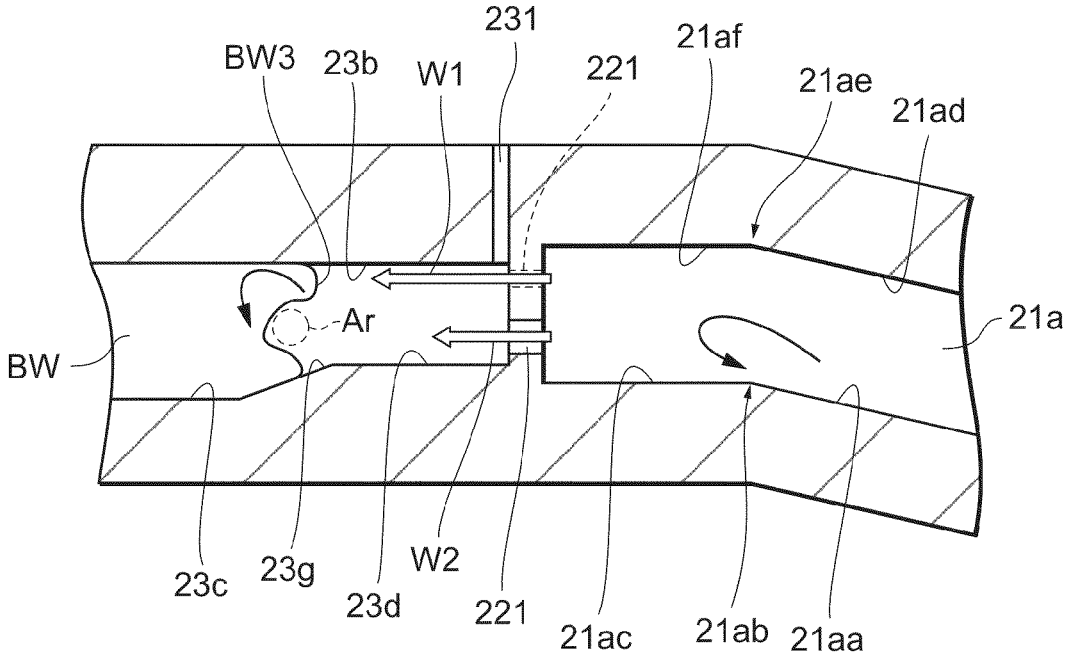
FIG. 5 is an enlarged sectional view magnifying and showing a throttle unit and its vicinity shown in FIG. 3.
Figure 6:
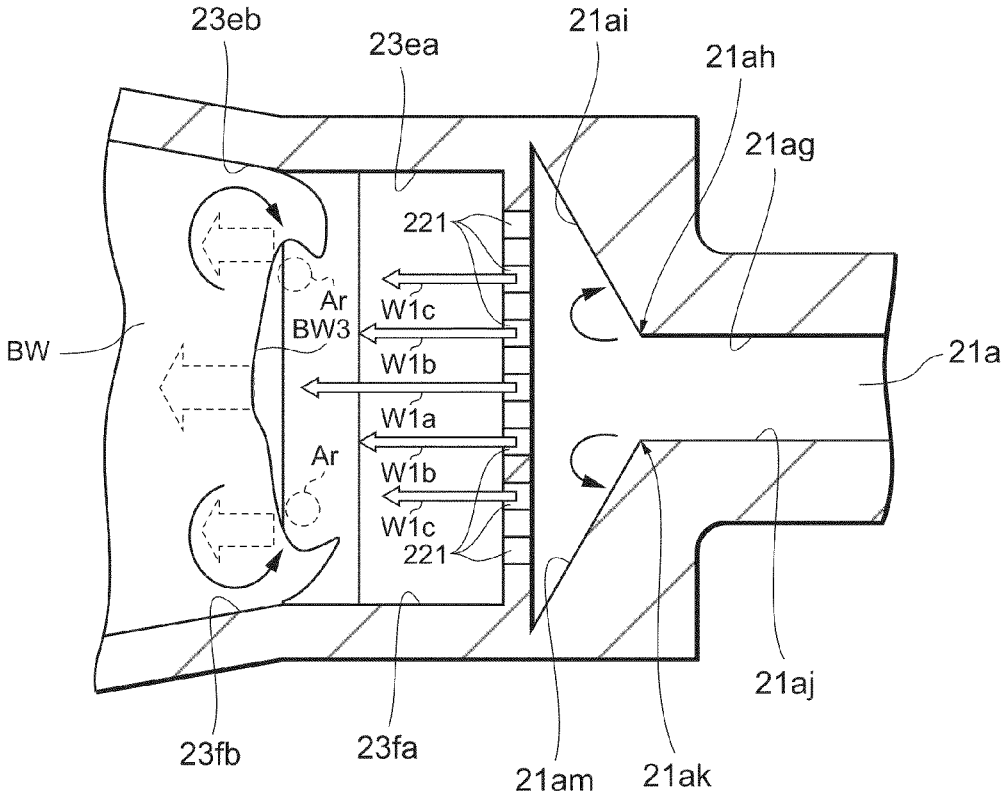
FIG. 6 is an enlarged sectional view magnifying and showing the throttle unit and its vicinity shown in FIG. 2.

The supply rate changing unit will be described with reference to FIGS. 5 and 6. FIG. 5 is an enlarged sectional view magnifying and showing the throttle unit 22 and its vicinity shown in FIG. 3. FIG. 6 is an enlarged sectional view magnifying and showing the throttle unit 22 and its vicinity shown in FIG. 2.

As shown in FIG. 5, the water passage 21*a* has upstream side walls 21*aa* and 21*ad* as well as downstream side walls 21*ac* and 21*af*. The side wall 21*aa* and side wall 21*ac* are located on the lower side in FIG. 5 while the side wall 21*ad* and side wall 21*af* are located on the upper side in FIG. 5. Incidentally, the up-and-down direction in FIG. 5 is orthogonal to the side wall 24*c* which forms the nozzle face in which the nozzle holes 243 are provided. The side wall 21*aa* and side wall 21*ac* are connected with each other, forming a convex portion 21*ab* which protrudes into the water passage 21*a*. On the other hand, the side wall 21*ad* and side wall 21*af* are connected with each other, forming a concave portion 21*ae* recessed from the water passage 21*a*. Thus, at least the side wall 21*aa* and side wall 21*ac* located on the lower side of the wall face of the water passage 21*a* in the water supply unit 21 are bent so as to form the convex portion 21*ab* as an inflection region protruding into the water passage 21*a*.

As the water passage 21*a* is bent in this way, water is supplied to the throttle channels 221 installed on the upper side at a faster speed than to the throttle channels 221 installed on the lower side. This is considered to be because after flowing along the side wall 21*aa*, when the water in the water passage 21*a* flows between the convex portion 21*ab* and the side wall 21*ac*, flow separation occurs around the convex portion 21*ab*, resulting in reduction in flow velocity on the side of the side wall 21*ac*.

Since water is supplied to the throttle channels 221 at a faster speed on the upper side than on the lower side, the speed of water streams W1 ejected from the throttle channels 221 on the upper side is fast while the speed of water streams water stream W2 ejected from the throttle channels 221 on the lower side is slow. When the water streams W1 and water streams W2 with such a speed difference plunge into an air-liquid interface BW3, a flow of water which takes in air Ar near the air-liquid interface BW3 is generated, producing bubbly water BW efficiently.

Also, as shown in FIG. 6, in a planar cross section, the water passage 21*a* has side walls 21*aj* and 21*ag* on the upstream side as well as side walls 21*am* and 21*ai* on the downstream side. The side wall 21*aj* and side wall 21*am* are located on the lower side in FIG. 6, and located on one side in the left-to-right direction in relation to the side wall 21*aa* and side wall 21*ac* shown in FIG. 5. Similarly, the side wall 21*ag* and side wall 21*ai* are located on the upper side in FIG. 6, and located on the other side in the left-to-right direction in relation to the side wall 21*aa* and side wall 21*ac* shown in FIG. 5. The side wall 21*aj* and side wall 21*am* are connected with each other, forming a convex portion 21*ak* which protrudes into the water passage 21*a*. Similarly, the side wall 21*ag* and side wall 21*ai* are connected with each other, forming a convex portion 21*ah* which protrudes into the water passage 21*a*. Thus, the side wall 21*am* and side wall 21*ai* are placed in such a way as to make the cross sectional area of the flow channel larger than a region made up of the side wall 21*ag* and side wall 21*aj* which make up the wall face of the water passage 21*a* of the water supply unit 21.

As the water passage 21*a* is widened in this way, water is supplied to the throttle channels 221 installed on the center side at a faster speed than to the throttle channels 221 installed on the lateral sides. This is considered to be because after flowing along the side wall 21*aj* in the water passage 21*a*, when the water flows between the convex portion 21*ak* and the side wall 21*am*, flow separation occurs around the convex portion 21*ak*, resulting in reduction in flow velocity on the side of the side wall 21*am* as well as because after flowing along the side wall 21*ag* in the water passage 21*a*, when the water flows between the convex portion 21*ah* and the side wall 21*ai*, flow separation occurs around the convex portion 21*ah*, resulting in reduction in flow velocity on the side of the side wall 21*ai*.

Since water is supplied to the throttle channels 221 at a faster speed on the center side than on the lateral sides, the speed of water streams W1*a* ejected from the throttle channels 221 on the center side is fast, the speed of water streams W1*b* ejected from the throttle channels 221 on the lateral sides is slow, and the speed of water streams W1*c* ejected from the throttle channels 221 on still lateral sides is sill slower. In this way, when the water streams W1*a*, W1*b*, and water streams W1*c* with such speed differences plunge into the air-liquid interface BW3, a flow of water which takes in air Ar near the air-liquid interface BW3 is generated, producing bubbly water BW efficiently.

Figure 7:
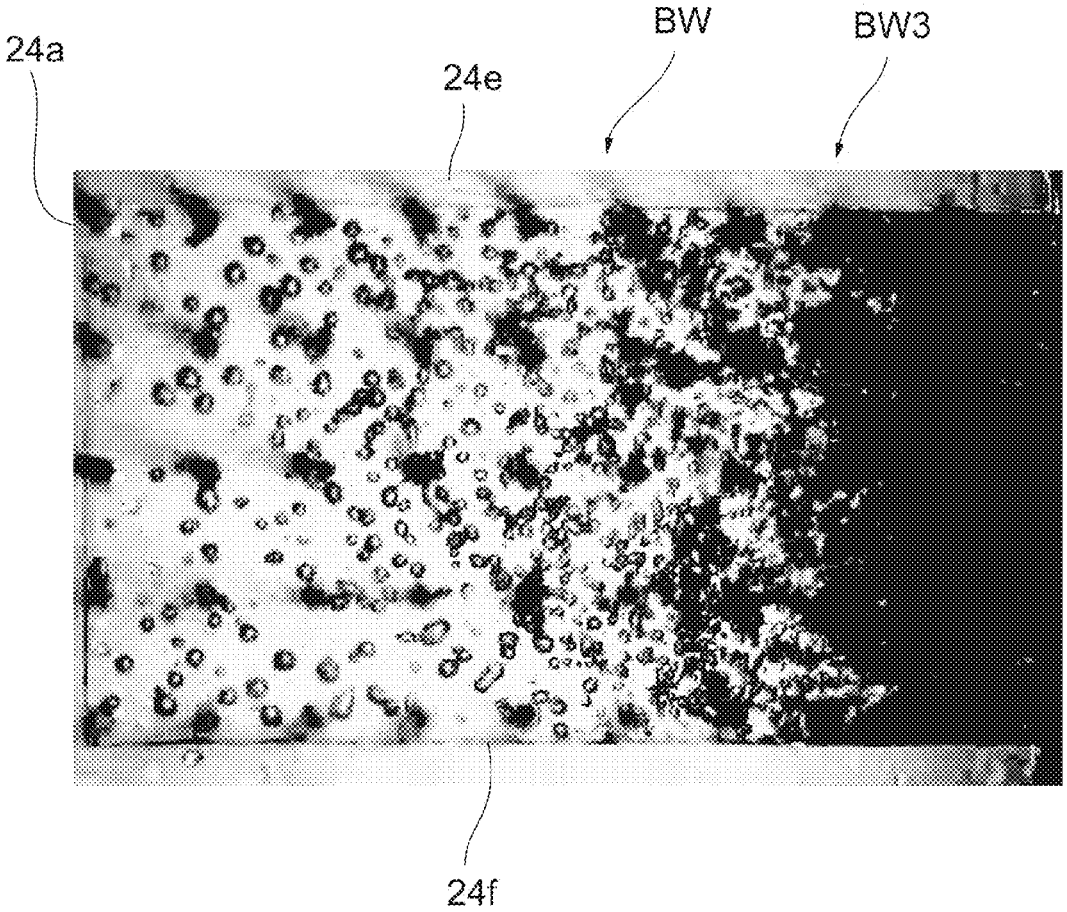
FIG. 7 is a diagram showing how bubbly water is produced in the shower apparatus according to the embodiment of the present invention.

In a stage in which the water ejected through the throttle unit 22 according to the present embodiment plunges into the air-liquid interface BW3 and thereby turns into bubbly water BW, the air bubbles in the bubbly water BW can be configured to have a substantially uniform diameter. Thus, the bubbly water BW can reach the location where the nozzle holes 243 are formed while maintaining the substantially uniform diameter. FIG. 7 shows how the bubbly water BW is produced with a substantially uniform bubble diameter maintained.

Figure 8:
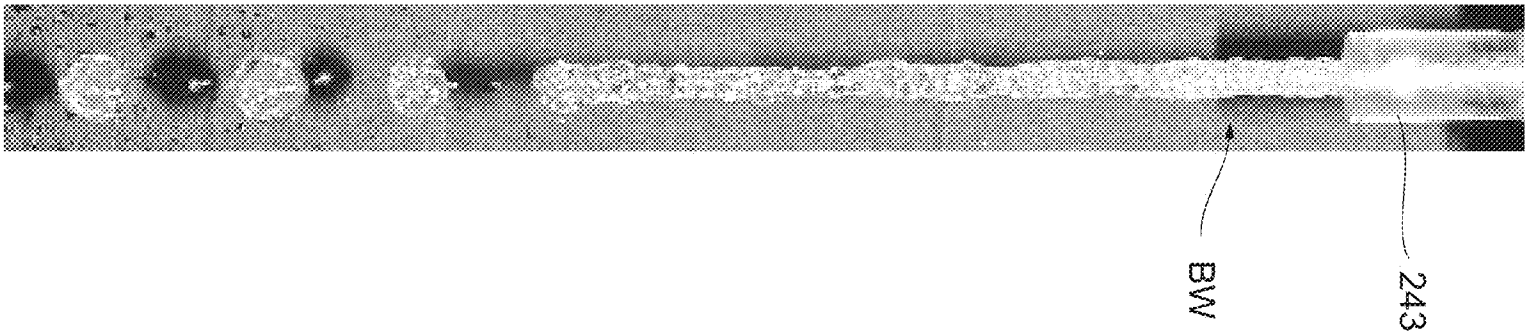
FIG. 8 is a diagram showing an example of how bubbly water is discharged by the shower apparatus according to the embodiment of the present invention.
Figure 9:
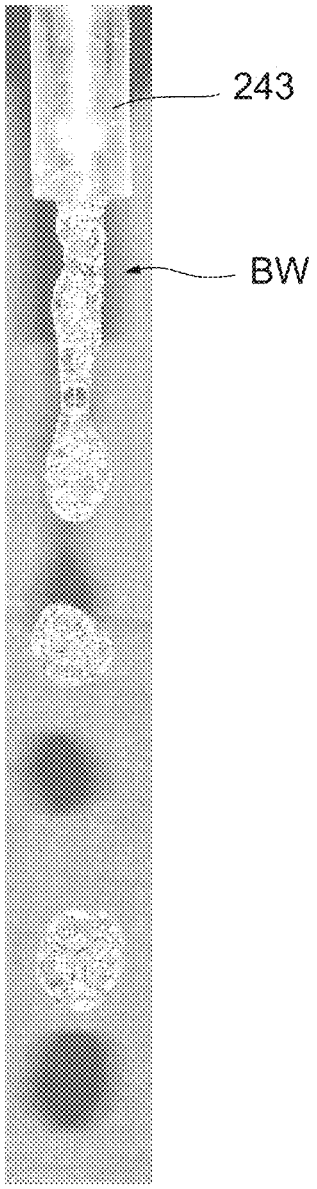
FIG. 9 is a diagram showing an example of how bubbly water is discharged by the shower apparatus according to the embodiment of the present invention.

As the bubbly water BW containing air bubbles of such a substantially uniform diameter is supplied to the nozzle holes 243, a bubble flow or slug flow can be formed in the nozzle holes 243 or just after discharge from the nozzle holes 243. When discharged from the nozzle holes 243, the bubbly water BW containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. FIGS. 8 and 9 show examples of how bubbly water BW is discharged from the nozzle holes 243 with a substantially uniform bubble diameter maintained. In the example shown in FIG. 8, bubbly water BW containing relatively small bubbles is discharged from the nozzle holes 243 and a bubble flow is formed in the nozzle holes 243 or just after discharge from the nozzle holes 243. In the example shown in FIG. 9, bubbly water BW containing relatively large bubbles substantially equal to the hole diameter of the nozzle holes 243 is discharged from the nozzle holes 243 and a slug flow is formed in the nozzle holes 243 or just after discharge from the nozzle holes 243.

As shown in FIGS. 8 and 9, the shower apparatus F1 according to the present embodiment can cause finely divided water droplets of relatively large, uniform size to land continuously on the user and thereby allow the user to enjoy a shower with a voluminous feel as if the user were being showered by large drops of rain.

Also, in the shower apparatus F1 according to the present embodiment, the throttle unit 22 is made up of a plurality of throttle channels 221 arranged side by side. In this way, since the throttle unit 22 is made up of a plurality of throttle channels 221 arranged side by side, the water ejected from the plurality of throttle channels 221 plunges into the air-liquid interface BW3 in parallel, turning the water temporarily pooled in the aeration unit 23 and the nozzle unit 24 into bubbly water BW. Thus, when bubbles are generated from the water ejected from adjacent throttle channels 221, the water streams formed by the plunging water affect each other and tear the bubbles generated by each other, achieving the effect of reducing the bubble diameter of the generated bubbles. In this way, by feeding the bubbly water BW containing bubbles substantially uniform and relatively small in diameter into nozzle holes 243, it is possible to achieve the operation and effect described above, allowing the user to enjoy a more comfortable shower with a voluminous feel as if the user were being showered by large drops of rain.

As described above, the shower apparatus F1 according to the present embodiment is a shower apparatus for discharging aerated bubbly water BW, comprising: the water supply unit 21 adapted to supply water; the throttle unit 22 installed downstream of the water supply unit 21 and adapted to make the cross sectional area of a flow channel smaller than the water supply unit 21 and thereby eject passing water downstream; an aeration unit 23 installed downstream of the throttle unit 22 and provided with the opening 231 adapted to produce the bubbly water BW by aerating the water ejected through the throttle unit 22; and a nozzle unit 24 installed downstream of the aeration unit 23 and provided with the plurality of nozzle holes 243 adapted to discharge the bubbly water BW and formed along the ejection direction of the water ejected through the throttle unit 22.

The throttle unit 22 comprises the plurality of throttle channels 221 installed in parallel. Also, to supply water to the throttle unit 22 by at least partially varying the supply rates of the water supplied to the respective throttle channels of the plurality of throttle channels 221 so as to at least partially vary ejection speeds of the water ejected from the respective throttle channels of the plurality of throttle channels 221, the supply rate changing unit is installed in the water supply unit 21.

According to the present embodiment, the water supplied from the water supply unit 21 is ejected to the aeration unit 23 and nozzle unit 24 through the throttle unit 22, and the water temporarily pooled in the aeration unit 23 and nozzle unit 24 is discharged outside through the plurality of nozzle holes 243 in the nozzle unit 24. By involving air taken in through the opening 231 formed in the aeration unit 23, the water ejected through the throttle unit 22 plunges into the air-liquid interface BW3 between air and the water temporarily pooled in the aeration unit 23 and nozzle unit 24 and thereby turns into bubbly water BW to be sprayed through the plurality of nozzle holes 243 in the nozzle unit 24.

In the stage in which the water ejected through the throttle unit 22 plunges into the air-liquid interface BW3 and thereby turns into bubbly water BW, the air bubbles in the bubbly water BW can be configured to have a substantially uniform diameter. Thus, the bubbly water BW can reach the location where the nozzle holes 243 are formed while maintaining the substantially uniform diameter. As the bubbly water BW containing air bubbles of such a substantially uniform diameter is supplied to the nozzle holes 243, a bubble flow or slug flow can be formed in the nozzle holes 243 or just after discharge from the nozzle holes 243. When discharged from the nozzle holes 243, the bubbly water BW containing air bubbles of such a substantially uniform diameter and formed as a bubble flow or slug flow in this way is finely divided substantially uniformly by being sheared in a direction substantially orthogonal to a discharge direction without being turned into a mist as in the case of an annular flow. This causes finely divided water droplets of relatively large, uniform size to land continuously on the user and thereby allows the user to enjoy a shower with a voluminous feel as if the user were being showered by large drops of rain.

Furthermore, according to the present embodiment, since the throttle unit 22 comprises the plurality of throttle channels 221 installed in parallel, water is ejected by being divided among the plurality of throttle channels 221 to produce bubbly water BW. This makes it possible to produce the bubbly water BW without greatly disturbing the flow of water. In this way, since the bubbly water BW is produced without greatly disturbing the flow of water, the air bubbles in the bubbly water BW tend to decrease if a usual method is used. Thus, the present invention curbs the decrease in the air bubbles by inducing flow of water near the air-liquid interface BW3 and thereby involving air with the ejected water. Specifically, by at least partially varying ejection speeds of the water ejected from the respective throttle channels of the plurality of throttle channels 221, the present embodiment induces such a flow of water that will involve air at the air-liquid interface BW3 using the difference among the ejection speeds and thereby increases the number of air bubbles without enlarging the air bubbles.

Furthermore, according to the present embodiment, in order to supply water to the throttle unit 22 by at least partially varying the supply rates of the water supplied to the respective throttle channels of the plurality of throttle channels 221 so as to at least partially vary ejection speeds of the water ejected from the respective throttle channels of the plurality of throttle channels 221, the supply rate changing unit is installed in the water supply unit 21.

The supply rate changing unit according to the present embodiment is formed by bending and widening the water passage 21*a*. Specifically, as shown in FIG. 5, the supply rate changing unit is provided in the form in which the water passage 21*a* is bent by means of the side wall 21*aa*, convex portion 21*ab*, and side wall 21*ac*. Also, as shown in FIG. 6, the supply rate changing unit is provided in the form in which the water passage 21*a* is widened by means of the side walls 21*aj* and 21*ag*, convex portions 21*ak* and 21*ah*, and side walls 21*am* and 21*ai*.

In this way, since the supply rate changing unit is installed in the water supply unit 21 to vary the supply rates of the water supplied to the plurality of throttle channels 221 and thereby vary the ejection speeds of the water ejected from the plurality of throttle channels 221, it possible to ensure a sufficient amount of bubble inclusion in the bubbly water BW using a simple configuration by making changes only to the water supply unit 21 without making particular changes to the throttle channels 221.

Also, with the shower apparatus F1 according to the present embodiment, the bubbly water BW is produced as the water ejected from each of the plurality of throttle channels 221 plunges into the air-liquid interface BW3 between air and the water temporarily pooled in the aeration unit 23 and nozzle unit 24, and the air-liquid interface BW3 is formed downstream of the opening 231, but upstream of the nozzle holes 243 (see FIG. 5).

As shown in FIGS. 5 and 6, the water ejected from the plurality of throttle channels 221 plunges into the air-liquid interface BW3 by being arranged in parallel lines. This allows forces applied by the ejected water to be transmitted evenly to the entire air-liquid interface BW3, making it possible to stably position the air-liquid interface BW3 between the nozzle holes 243 and opening 231. In this way, since the shower apparatus F1 stably forms the air-liquid interface BW3, produces bubbly water BW by causing the water ejected from the plurality of throttle channels 221 to plunge into the air-liquid interface BW3, and creates differences among the ejection speeds of the water ejected from the plurality of throttle channels 221, it is possible to induce such a flow of water that will involve surrounding air Ar at the stable air-liquid interface BW3 using the differences among the ejection speeds and thereby increase the number of air bubbles without enlarging the air bubbles.

Also, in the shower apparatus F1 according to the present embodiment, as shown in FIG. 6, at least some of the plurality of throttle channels 221 are arranged side by side in the lateral direction along the side wall 24*c* serving as the nozzle face in which the plurality of nozzle holes 243 are provided, and the water is ejected from the plurality of throttle channels 221 such that the speed of the water ejected from the throttle channels 221 installed on the center side and the speed of the water ejected from the throttle channels 221 installed on the lateral sides will be different from each other. More specifically, the water is ejected from the plurality of throttle channels 221 such that the speed of the water ejected from the throttle channels 221 installed on the center side will be faster than the speed of the water ejected from the throttle channels 221 installed on the lateral sides.

As shown in FIG. 6, since at least some of the plurality of throttle channels 221 are arranged side by side in the lateral direction along the side wall 24*c* serving as the nozzle face in which the plurality of nozzle holes 243 are provided, the throttle channels 221 are arranged by being spread out and scattered in the lateral direction, thereby making it easy to change the speeds of ejected water in the lateral direction in which the throttle channels 221 ejecting the water are arranged side by side. Furthermore, the water is ejected from the plurality of throttle channels 221 such that the speed of the water ejected from the throttle channels 221 installed on the center side and the speed of the water ejected from the throttle channels 221 installed on the lateral sides will be different from each other. Since the speed of the water on the lateral sides can be differed from the speed of the water on the center side, it easy to eject water with a speed difference, and possible to induce such a flow of water that will involve surrounding air Ar at the air-liquid interface BW3 using the differences among the ejection speeds and thereby increase the number of air bubbles without enlarging the air bubbles. In particular, by reducing the water ejection speed on the lateral sides with respect to the center side from which water is ejected at a faster speed, the speed of ejected water can be varied with regularity, making it possible to involve air Ar while suppressing disturbance of water near the air-liquid interface BW3 and thereby increase the number of air bubbles without enlarging the air bubbles.

Also, in the shower apparatus F1 according to the present embodiment, as shown in FIG. 6, the lateral length (shown in FIG. 6 as being in the vertical direction) along which the throttle channels 221 of the throttle unit 22 are arranged side by side is longer than the water passage diameter (which corresponds to the distance between the side wall 21*aj* and side wall 21*ag*) in the water passage 21*a* of the water supply unit 21.

In this way, since the length of the throttle unit 22 in the direction along which the throttle channels 221 are arranged side by side is configured to be longer than the water passage diameter of the water passage 21 in the water supply unit 21, the water entering the throttle unit 22 by being supplied to the center side of the throttle unit 22 from the water supply unit 21 spreads to the lateral sides, causing water to be ejected from the throttle channels 221 installed on the center side at a faster speed than from the throttle channels 221 installed on the lateral sides. Thus, by simply configuring the lateral length of the throttle unit 22 to be longer than the water passage diameter of the water passage 21*a* in the water supply unit 21, it is possible to supply water with a speed difference to the throttle channels 221.

Also, in the shower apparatus F1 according to the present embodiment, as shown in FIG. 4, at least some of the plurality of throttle channels 221 are arranged by being offset from each other in the up-and-down direction orthogonal to the side wall 24*c* serving as the nozzle face in which the plurality of nozzle holes 243 are provided. Also, as shown in FIG. 5, the water ejected from the plurality of throttle channels 221 is varied in speed depending on locations along the up-and-down direction. More specifically, the water is ejected from the plurality of throttle channels 221 such that the speed of the water ejected from the throttle channels 221 installed on the upper side will be faster than the speed of the water ejected from the throttle channels 221 installed on the lower side. Regarding the mode of arranging the plurality of throttle channels 221 by offsetting them from each other vertically, preferably, for example, the throttle channels 221 placed in the same tier are offset vertically, forming an arch. Also, as shown in FIG. 5, preferably the plurality of throttle channels 221 are arranged by being divided into a plurality of tiers in the up-and-down direction. Also, as shown in FIG. 5, preferably the plurality of throttle channels 221 are arranged such that the throttle channels 221 placed in a first tier and the throttle channels 221 placed in a second tier will be offset in position from each other, being arranged in a staggered fashion.

According to the present embodiment, at least some of the plurality of throttle channels 221 are arranged by being offset from each other in the up-and-down direction and the water ejected from the plurality of throttle channels 221 is varied in speed depending on locations along the up-and-down direction. Since the throttle channels 221 are arranged by being spread out and scattered in the vertical direction, it is easy to change the speeds of the water ejected from the throttle channels 221 arranged by being offset from each other in the vertical direction.

Also, according to the present embodiment, as shown in FIG. 5, since the water is ejected from the throttle channels 221 installed on the upper side at a faster speed than from the throttle channels 221 installed on the lower side, bubbly water is produced by taking in a larger amount of air on the upper side where the faster water streams pass. Therefore, although the opening 231 is provided only on the upper side of the aeration unit 23 (see FIGS. 1 and 3), air can be taken in reliably using the faster water streams, making it possible to facilitate the flow of water ejected from the throttle channels 221.

Also, according to the present embodiment, as shown in FIG. 4, since the plurality of throttle channels 221 are arranged by being divided into a plurality of tiers in the up-and-down direction, thereby causing the plurality of throttle channels 221 to be offset from each other in the up-and-down direction, the positional offset in the up-and-down direction becomes prominent. This makes it easy to increase the amount of air intake by more prominently changing the speeds of the water ejected from the throttle channels 221 arranged by being offset from each other in the vertical direction.

Also, according to the present embodiment, as shown in FIG. 4, since the throttle channels 221 placed in the upper tier, i.e., the first tier, and the throttle channels 221 placed in the second tier, i.e., the lower tier, are offset in position from each other, being arranged in a staggered fashion, each of the throttle channels 221 placed in the lower tier, i.e., the second tier, can be positioned below an interval between a pair of throttle channels 221 in the upper tier, i.e., the first tier. This makes it easy to provide a predetermined distance so as to prevent the water ejected from the throttle channels 221 placed in the upper tier, i.e., the first tier, from colliding with the water ejected from the throttle channels 221 placed in the lower tier, i.e., the second tier. Consequently, it becomes possible to reduce collisions among the water streams ejected from the plurality of throttle channels 221 and inhibit enlargement of the air bubbles while making it easy to increase the amount of air intake by more prominently changing the speeds of the water ejected from the throttle channels 221 arranged by being offset from each other in the vertical direction.

Also, according to the present embodiment, by placing the plurality of throttle channels 221 at equal intervals, it becomes possible to reduce interference among the water streams ejected from the plurality of throttle channels 221, suppress disturbance of water near the air-liquid interface BW3, and inhibit enlargement of the air bubbles.

Also, in the shower apparatus according to the present embodiment, as shown in FIG. 5, at least the side walls 21*aa* and 21*ac* located on the lower side of the wall face of the water passage 21*a* in the water supply unit 21 are bent so as to form the convex portion 21*ab* as an inflection region protruding into the water passage 21*a*, causing water to be supplied to the throttle channels 221 installed on the upper side at a faster speed than to the throttle channels 221 installed on the lower side.

In this way, since at least the side walls 21*aa* and 21*ac* located on the lower side of the wall face of the water passage 21*a* in the water supply unit 21 are bent so as to form the convex portion 21*ab* as an inflection region protruding into the water passage 21*a*, as water passes the bent portion, an apparent flow channel expands suddenly, causing flow separation and thereby resulting in a speed difference. Thus, by simply bending the water passage 21*a* of the water supply unit 21, a speed difference can be created in the up-and-down direction of the water supplied to the throttle unit 22. This makes it possible to supply water to the throttle channels 221 installed on the upper side at a faster speed than to the throttle channels 221 installed on the lower side.

As described above, in the shower apparatus F1 according to the present embodiment, since the plurality of throttle channels 221 are arranged side by side in the lateral direction along the side wall 24*c* as well as arranged by being offset from each other in the up-and-down direction orthogonal to the side wall 24*c*, the side wall 24*c* serving as the nozzle face in which the plurality of nozzle holes 243 are provided, the water is ejected from the plurality of throttle channels 221 such that the speed of the water ejected from the throttle channels 221 installed on the center side and the speed of the water ejected from the throttle channels 221 installed on the lateral sides will be different from each other in the lateral direction and that there will also be a speed difference depending on locations along the up-and-down direction.

In this way, the plurality of throttle channels 221 are arranged side by side in the lateral direction along the side wall 24*c* as well as arranged by being offset from each other in the up-and-down direction orthogonal to the side wall 24*c*, the side wall 24*c* being the nozzle face in which the plurality of nozzle holes 243 are provided, and thus the throttle channels 221 are arranged by being scattered both in the lateral direction and up-and-down direction. Since the throttle channels 221 are arranged by being spread out and scattered in the lateral direction, it is easy to change the speeds of ejected water in the lateral direction in which the throttle channels 221 ejecting the water are arranged side by side. Furthermore, since the throttle channels 221 are arranged by being spread out and scattered in the vertical direction, it is easy to change the speeds of the water ejected from the throttle channels 221 arranged by being offset from each other in the vertical direction.

Incidentally, according to the present embodiment, as the ejection speed changing means intended to at least partially vary ejection speeds of the water ejected from the respective throttle channels of the plurality of throttle channels 221, the supply rate changing unit is installed in the water supply unit 21, being configured to supply water to the throttle unit 22 by at least partially varying the supply rates of the water supplied to the respective throttle channels of the plurality of throttle channels 221. Specifically, the supply rate changing unit is configured by bending and widening the water passage 21*a*. However, when the ejection speed changing means is viewed as being intended to at least partially vary ejection speeds of the water ejected from the respective throttle channels of the plurality of throttle channels 221, the ejection speed changing means is not limited to the supply rate changing unit described in the present embodiment. For example, it is also preferable that a channel flow velocity changing unit adapted to change the flow velocity of the water flowing through the plurality of throttle channels 221 are installed in the plurality of throttle channels 221. The channel flow velocity changing unit may be configured to vary the lengths of a plurality of throttle channels from each other, vary the cross sections of the plurality of throttle channels from each other, or the like, as required.

An embodiment of the present invention has been described above with reference to concrete examples. However, the present invention is not limited to these concrete examples. That is, when those skilled in the art make design changes to any of the concrete examples, the resulting variations are also included in the scope of the present invention as long as the variations contain features of the present invention. For example, the components of the above-described concrete examples as well as the arrangements, materials, conditions, shapes, sizes, and the like of the components are not limited to those illustrated above, and may be changed as required. Also, the components of the above-described embodiments may be combined as long as it is technically possible, and the resulting combinations are also included in the scope of the present invention.

What is claimed is:

1. A shower apparatus for discharging aerated bubbly water, comprising:

a water supply unit adapted to supply water;

a throttle unit which, being installed downstream of the water supply unit, comprises a plurality of throttle channels installed in parallel so as to make a total cross sectional area of the plurality of throttle channels smaller than a cross sectional area of a water passage in the water supply unit and thereby eject passing water downstream;

an aeration unit installed downstream of the throttle unit and provided with an opening adapted to produce the bubbly water by aerating the water ejected through the throttle unit; and a nozzle unit installed downstream of the aeration unit and provided with a plurality of nozzle holes being orthogonal with respect to the ejection direction and adapted to discharge the bubbly water by being formed along an ejection direction of the water ejected through the throttle unit;

wherein at least some of the plurality of throttle channels are arranged side by side in a lateral direction along a nozzle face in which the plurality of nozzle holes are provided, wherein water is ejected from the plurality of throttle channels such that the speed of the water ejected from the throttle channels installed on the center side will be faster than the speed of the water ejected from the throttle channels installed on the lateral side, wherein the cross sectional area of the water passage in the downstream side of the water supply unit is larger than the cross sectional area of the water passage in the upstream side of the water supply unit, such that a lateral length from the throttle channel formed at one end in the lateral direction to the throttle channel formed at the other end in the lateral direction is longer than a water passage diameter at the water supply unit, and wherein none of virtual water ejection straight lines which are orthogonal to an extending direction of the nozzle holes and drawn from the plurality of throttle channels between the throttle channels and the nozzle unit downstream of the ejection direction intersects with an internal wall of the shower apparatus corresponding to the water passage arranged between the throttle channels and the nozzle unit.

2. The shower apparatus according to claim 1, wherein:

at least some of the plurality of throttle channels are arranged by being offset from each other in an up-and-down direction orthogonal to a nozzle face in which the plurality of nozzle holes are provided; and water ejected from the plurality of throttle channels is varied in speed depending on locations along the up-and-down direction.

3. The shower apparatus according to claim 2, wherein the water is ejected from the plurality of throttle channels such that the speed of the water ejected from the throttle channels installed on an upper side will be faster than the speed of the water ejected from the throttle channels installed on a lower side.

4. The shower apparatus according to claim 3, wherein a wall face of a water passage of the water supply unit is bent at least on the lower side so as to form a bent region protruding into the water passage, causing water to be supplied to the throttle channels installed on the upper side at a faster speed than to the throttle channels installed on the lower side.

5. The shower apparatus according to claim 2, wherein the plurality of throttle channels are arranged by being divided into a plurality of tiers in the up-and-down direction.

6. The shower apparatus according to claim 5, wherein the plurality of throttle channels are arranged in a staggered fashion such that the throttle channels placed in a first tier will be offset in position from the throttle channels placed in a second tier.

7. The shower apparatus according to claim 6, wherein the plurality of throttle channels are placed at equal intervals.

8. The shower apparatus according to claim 7, wherein the plurality of throttle channels are placed at equal intervals.

9. The shower apparatus according to claim 1, wherein virtual water ejection straight lines drawn from all of the plurality of throttle channels along the ejection direction are not intersected with a structure of the aeration unit.

10. The shower apparatus according to claim 1, wherein a lateral length downstream of the aeration unit is longer than a lateral length upstream of the aeration unit so as to expand the water passage gradually from the upstream side to the downstream side.

* * * * *